US005695056A

United States Patent [19]

Bender et al.

[11] Patent Number: 5,695,056

[45] Date of Patent: Dec. 9, 1997

[54] BALL PACKAGE

[75] Inventors: Anthony J. Bender, York, Pa.; Kai H. Mui, Baltimore; Emery A. Pajer, Owings Mills, both of Md.

[73] Assignee: FILA U.S.A., Inc., Sparks, Md.

[21] Appl. No.: 746,370

[22] Filed: Nov. 8, 1996

[51] Int. Cl.[6] ..... B65D 85/58

[52] U.S. Cl. ..... 206/315.9; 206/315.2; 206/485; 206/730; 206/780; 211/14

[58] Field of Search ..... 206/315.9, 315.91, 206/315.1, 315.2, 485, 485.1, 730, 779, 780; 211/14

[56] References Cited

U.S. PATENT DOCUMENTS

| | | | |
|---|---|---|---|
| D. 267,474 | 1/1983 | Maroszek . | |
| D. 267,475 | 1/1983 | Maroszek . | |
| D. 359,681 | 6/1995 | Murphy . | |
| 1,301,161 | 4/1919 | Ohara . | |
| 1,920,837 | 8/1933 | Birdsey . | |
| 1,952,627 | 3/1934 | Karper . | |
| 2,301,042 | 11/1942 | Hanson . | |
| 2,313,718 | 3/1943 | Berg . | |
| 3,089,632 | 5/1963 | Bartolucci . | |
| 3,182,846 | 5/1965 | Kaff . | |
| 3,314,532 | 4/1967 | Henry . | |
| 3,756,299 | 9/1973 | Simmons et al. . | |
| 3,815,735 | 6/1974 | Cucuo . | |
| 3,889,807 | 6/1975 | Feinberg | 206/315.9 |
| 3,987,893 | 10/1976 | Hanson | 206/779 |
| 4,103,773 | 8/1978 | Haber | 211/14 |
| 4,214,684 | 7/1980 | Galowitz | 206/315.9 |
| 4,807,808 | 2/1989 | Reed . | |
| 4,905,822 | 3/1990 | Bosco . | |
| 4,993,548 | 2/1991 | Peterson . | |
| 5,289,916 | 3/1994 | Mickelberg . | |
| 5,553,707 | 9/1996 | Lion | 206/315.9 |

*Primary Examiner*—Paul T. Sewell
*Assistant Examiner*—Luan K. Bui
*Attorney, Agent, or Firm*—Fish & Richardson P.C.

[57] ABSTRACT

A ball package that includes a bottom member and a top member connected together by a plurality of columnar members is described. The top and bottom members each have a substantially planar base for resting on a surface, front and rear panels, side panels and inner panels. The front, rear and inner panels form a cavity or cavities for receiving one or more balls therein. The package firmly grips the ball or balls, and permits a consumer to view and to touch the surface without removing the ball from the package.

16 Claims, 4 Drawing Sheets

BALL PACKAGE

BACKGROUND OF THE INVENTION

Basketballs, footballs, soccer balls, volley balls, tennis balls, baseballs, golf balls and the like are commonly sold packaged in containers of appropriate size and shape. The containers are typically marked to identify the ball according to quality, size, make, quantity, price and so forth. However, in spite of the markings, a consumer will often pry open a package to remove the ball for examination before making a purchase. If the flaps of the package are tightly engaged, or if some or all of the package contains a plastic covering, the package may be ripped or torn as the ball is removed for inspection. Some consumers, after removing the ball and replacing it, will not buy the article and will not bother to properly reclose the package. As a result, the retailer may be saddled with one or more damaged ball packages that subsequent purchasers will avoid when buying a ball.

U.S. Pat. No. 3,815,735 describes a carton for holding a ball having two convex side walls and two concave side walls. The concave side walls have elliptical openings through which surface portions of the ball project. However, a relatively small portion of the ball projects outside the carton, and it appears that a consumer may rotate the ball causing surface markings to become obscured by the carton. Further, because the described carton has closure means on its bottom wall and handle elements on its top wall, the carton is not easily stackable.

Thus, there is a need for a ball package having features that provide increased viewability and permit a consumer to touch the surface of the ball to check the texture and finish. Such a package must be able to grip the ball such that it cannot be rotated to obscure its surface markings, and must be easy to stack for display and storage purposes.

SUMMARY OF THE INVENTION

A ball package according to the invention includes a bottom member and a top member connected together by a plurality of columnar members. The top and bottom members have a substantially planar base for resting on a surface, a front and rear panel, a left and right side panel, and a left inner and right inner side panel. The front, rear, left inner and right inner panels form a centrally disposed cavity for receiving a portion of a ball. The left inner and right inner panels contain openings for receiving the columnar members. The columnar members are substantially the same length as the diameter of the ball, and when the package is assembled, the top base member, bottom base member and columnar members of the package tightly grip the ball, such that a large portion of the middle of the ball's surface is accessible to a consumer.

The package may further include a plurality of screws for securing the columnar members to the top and bottom members. Such construction is advantageous because adjustments can be made during formation of the package to ensure that the ball is securely gripped by the panels of the top and bottom members and by the columnar members.

The top and bottom members may be formed from a unitary piece of material, such as cardboard. Alternately, other materials such as plastic, metal or a composite material may be used. In addition, the top and bottom members may be rectangular in shape.

A ball package according to the invention permits a consumer to touch a large surface area of the ball without removing the ball from the package. The package provides enhanced viewability and grip space to a consumer in comparison to prior art packages. Further, the top and bottom members and columnar members grip the ball such that it cannot be rotated within the package to obscure any of the surface markings found on the ball, such as trademarks or designs. Yet further, the top and bottom members have substantially planar surfaces that are parallel to each other to permit stable, free-standing packages that can be stacked on top of one another. Since the ball is firmly gripped within the package, it is stabilized and therefore less likely to cause tipping of such stacked packages.

DESCRIPTION OF THE PREFERRED EMBODIMENTS

Figure 1:
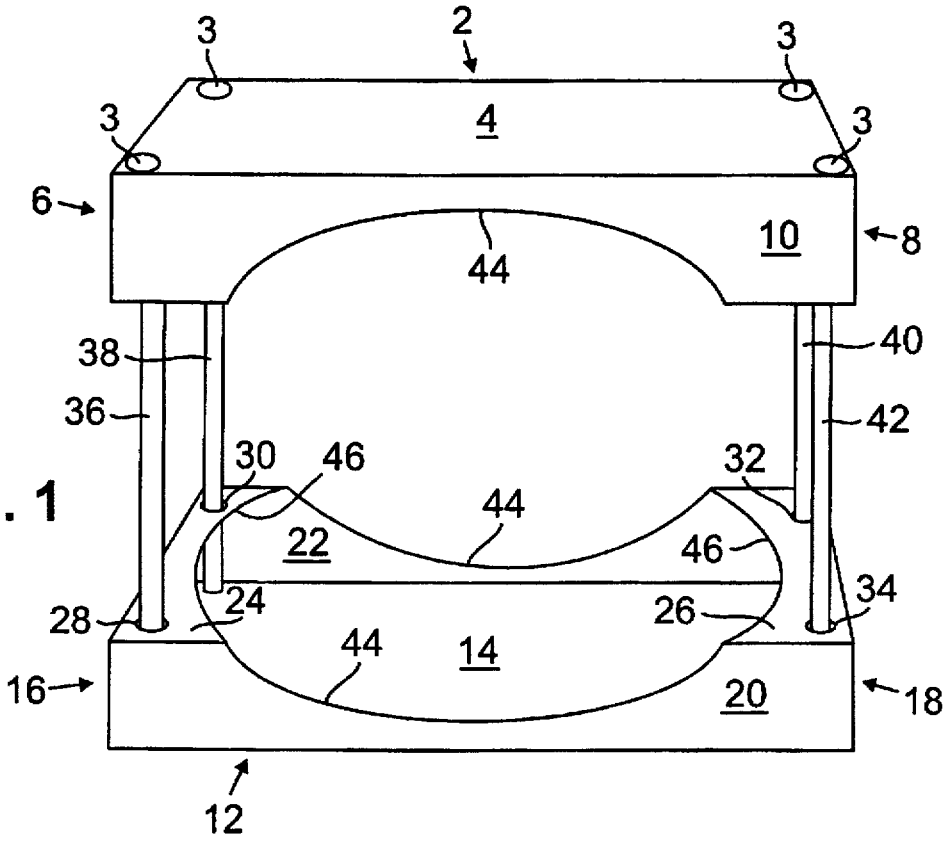
FIG. 1 is a front perspective front view of a ball package according to the invention.
Figure 2:
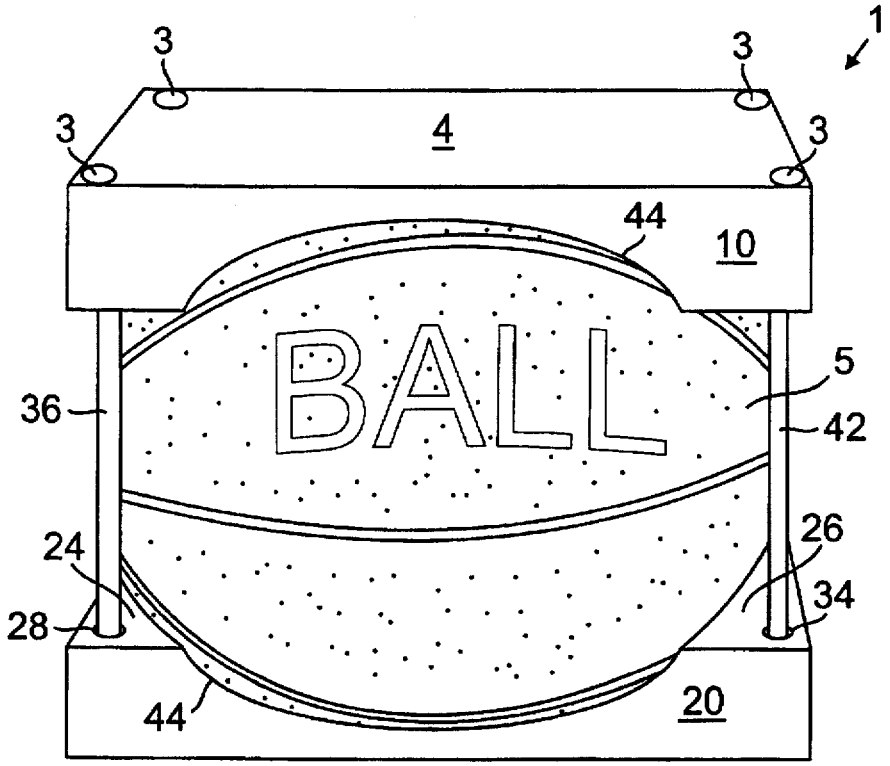
FIG. 2 illustrates the ball package of FIG. 1 containing a basketball.
Figure 3:
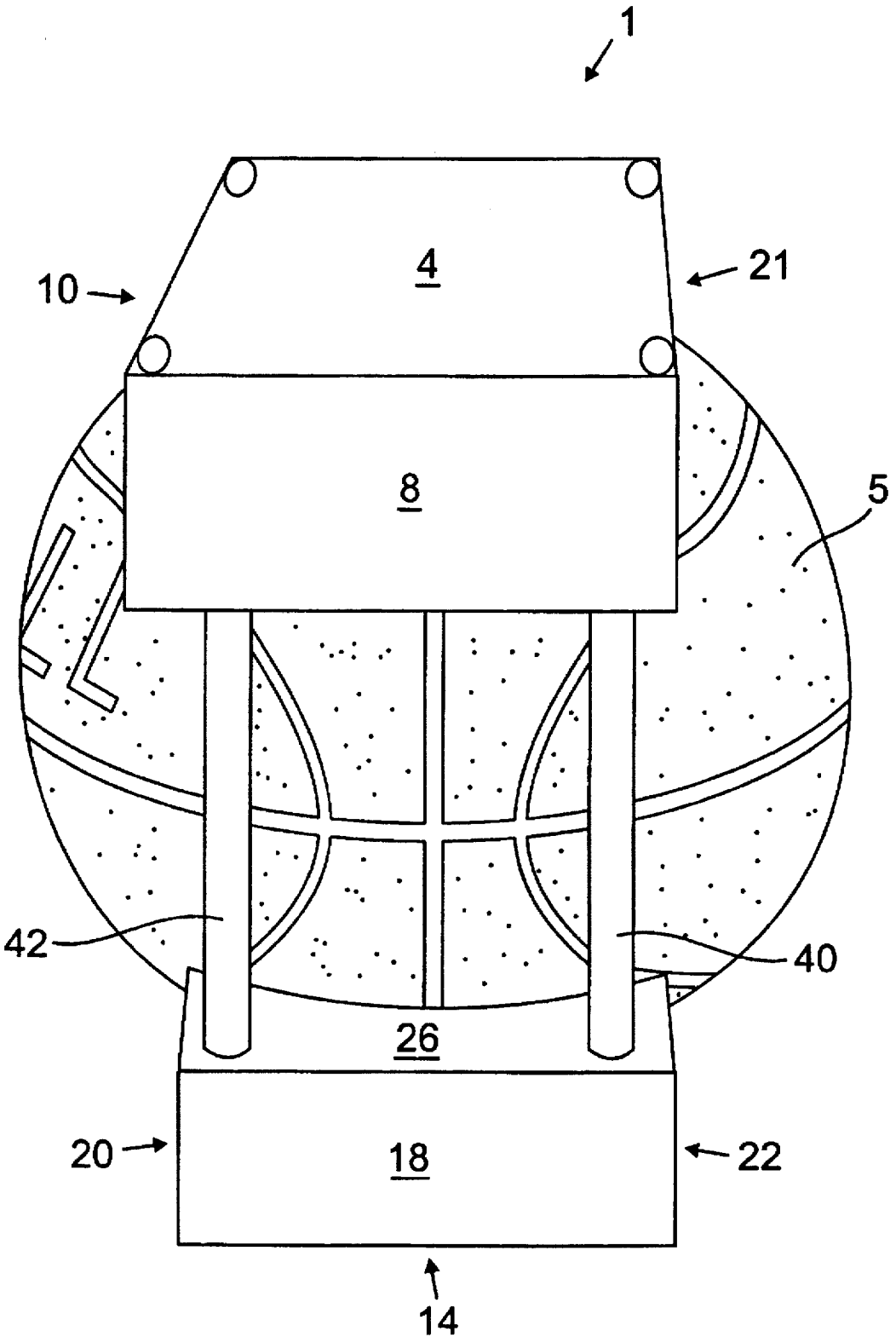
FIG. 3 is a side perspective view of the ball package of FIG. 2.

FIGS. 1, 2 and 3 depict an embodiment of a sports ball package 1 according to the invention, wherein like reference numbers refer to like parts. Referring to FIG. 1, a perspective front view of the sports ball package 1 is shown. The ball package 1 includes a top base member 2 having a substantially planar rectangular top portion 4, rectangular left and right top side members 6, 8 (see also FIG. 3), a front top ball holder panel 10, rear top ball holder panel (not shown), left and right inner ball holder panels (not shown), and openings in the inner ball holder panels (not shown). A bottom base member 12 is a mirror image of the top base member 2 and has the same dimensions. The bottom base member 12 includes a substantially planar rectangular floor portion 14, rectangular left 16 and right 18 bottom side members (see FIG. 3), a front bottom ball holder panel 20, a rear bottom ball holder panel 22, a bottom left inner ball holder panel 24, a bottom right inner ball holder panel 26, and four openings 28, 30, 32, 34 in the inner ball holder panels 24, 26. Each of the four openings 28, 30, 32, 34 receives one of four columns 36, 38, 40, 42. The columns are preferably connected to the top portion 4 and floor 14 via plastic screws 3 (see FIG. 5A). However, the columns may be glued or otherwise attached to the top and bottom base members. As shown, the ball package 1 may rest on a surface on the floor portion 14, or may be turned upside down so that the top portion 4 is resting on the surface.

It should be understood that, although the ball package 1 embodiment of FIGS. 1–3 is generally rectangular, other package shapes are contemplated. For example, the ball package may have circular top and bottom base elements such that the overall package would be cylindrical in shape. Alternately, depending on the shape of the base elements, the resulting ball package may be spheroid, triangular, square or of some other parallelipiped shape. Furthermore, the use of more or less than four columns in the package is contemplated.

It should also be understood that various materials could be used in the construction of a ball package depending on the contemplated use. Consequently, the top 2 and bottom 12 base members of the package may be constructed of cardboard, plastic, metal or other composite material. However, a recyclable cardboard construction is preferred. In addition, the columns may be wooden dowels, or may be made of plastic, rubber, metal or some composite material. The columns may have a square, rectangular, triangular or other type cross-sectional area and need not resemble each other in the construction of a particular ball package. For example, if a bowling ball were to be housed in the ball package, a durable plastic or metal material may be required for use in construction of the base members and/or columnar members, so that the package is strong enough to support the weight of the ball.

FIG. 2 is a perspective front view of the ball package 1 of FIG. 1 containing a basketball 5 having the word "BALL" written on its face. Although a basketball is depicted in this example, other balls such as soccer balls, volleyballs, footballs, softballs, bowling balls and the like are suitable for being housed in a package 1 according to the invention. To that end, a package according to the invention would be sized and constructed accordingly to hold one or more sports balls therein.

Referring to FIG. 2, the top front ball holder panel 10, top rear ball holder panel (not shown), top right and left inner ball holder panels (not shown), bottom front 20 and rear 22 ball holder panels, bottom inner right 24 and inner left 26 ball holder panels and the four columns 36, 38, 40, 42 act together to firmly grip the ball 5 within the ball package 1. The length of each of the columns 36, 38, 40 and 42 is substantially the same as the diameter of the basketball 5 to ensure a snug fit. Similarly, the curvature 44 (see also FIG. 1) of each of the ball holder panels (the top front 10 and top rear ball panels and the bottom front 20 and rear 22 ball panels) and the curvature 46 (see FIG. 1) of each of the four inner ball holder panels (top inner left and right ball holder panels, and bottom inner left 24 and right 26 ball holder panels) are formed to snugly encase the basketball 5. These curvatures 44, 46 will vary depending on the size of the ball to be encased in the package.

FIG. 3 is a perspective right side view of the ball package 1 of FIG. 2, showing how the basketball 5 protrudes beyond the top 10 and bottom 20 front holder panels and the rear top 21 and bottom 22 ball holder panels. A fairly large surface area of the basketball 5 is thus accessible to a consumer to enable her to touch and check the surface of the basketball 5 for quality of finish and feel of the ball. The top 2 and bottom 12 base members along with the columns 36, 38, 40, 42 together firmly grip the ball 5, such that the ball cannot be rotated to obscure any brand names, logos or any other surface markings such as the word "BALL" in this example. This package therefore allows a consumer to have access to the surface of the ball without having to remove it from the package. Furthermore, the top portion 4 and floor portion 14 are substantially planar and parallel to each other, which permits a retailer to stack the packages on top of one another to create an appealing display of ball packages for sale in a retail outlet. Furthermore, the ball packages can be easily stacked for storage purposes.

Figure 6:
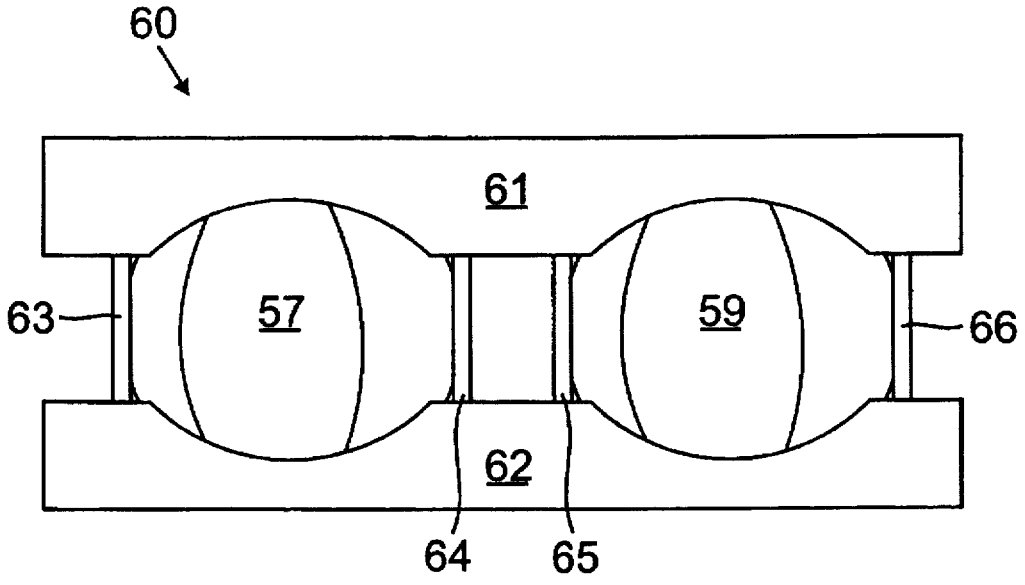
FIG. 6 illustrates an alternate embodiment of a ball package.

It should be understood that a ball package according to the invention could also be designed to hold a plurality of balls, not just one as shown in the examples of FIGS. 1–3 (see for example, FIG. 6). Furthermore, one of skill in the art would understand that the upper and lower base members, and the placement of the columns, could be designed to hold other types of articles.

Figure 4:
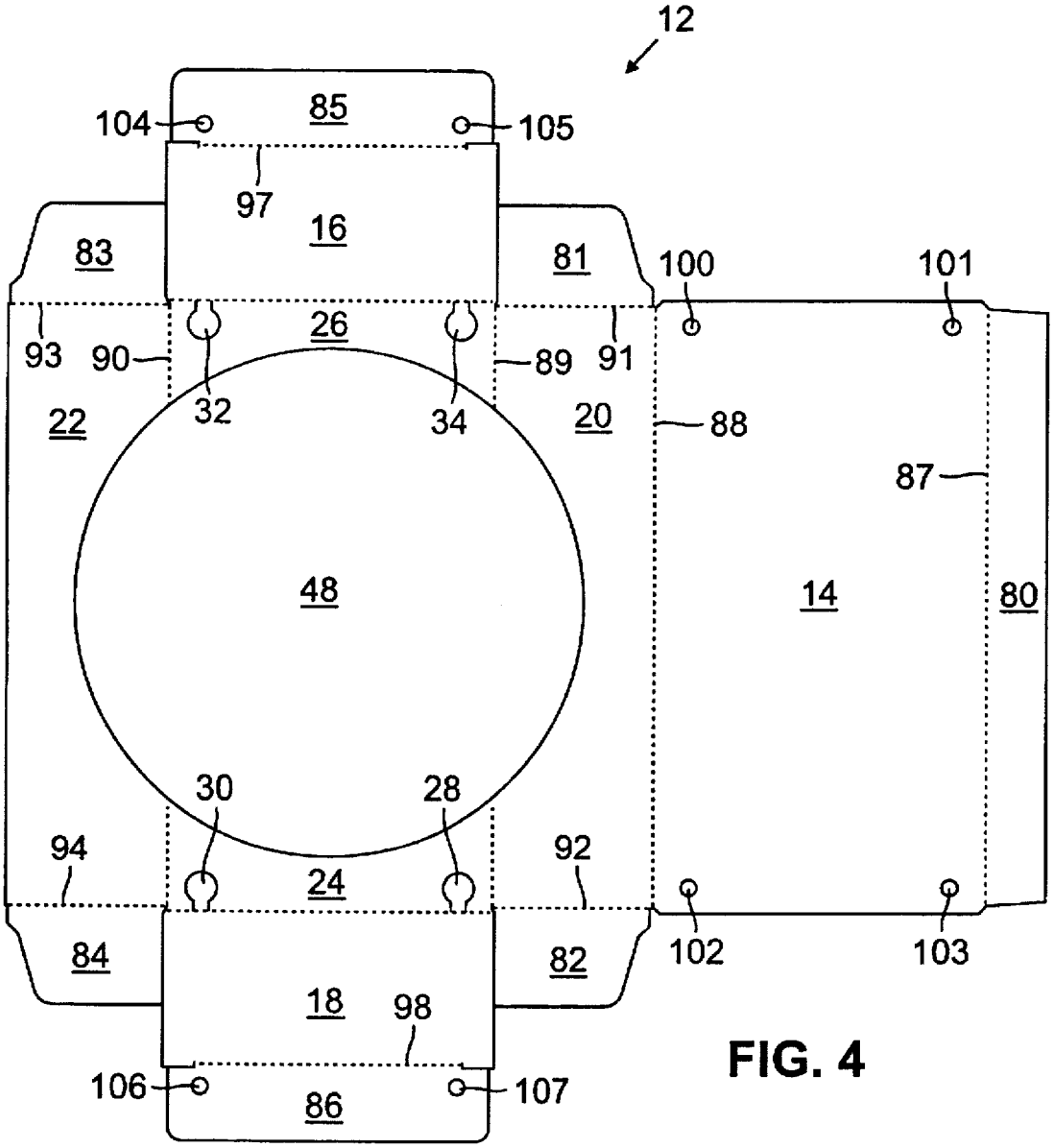
FIG. 4 is a top plan view of a unitary top member prior to folding and assembly.

FIG. 4 is a top plane view of a blank, unitary base member 12 after it has been stamped and scored from a single piece of cardboard, but prior to folding and assembly. For ease of understanding, the same reference numbers assigned to the bottom base member 12 of FIG. 1 will be used in conjunction with FIG. 4, so that the reader can easily refer back to the assembled base member 12 of FIG. 1 if desired.

Referring to FIG. 4, the base member 12 has a rectangular floor 14, side panels 16, 18, front and rear ball holder panels 20, 22, inner ball holder panels 24, 26, and four column openings 28, 30, 32 and 34. Although four spaced apart column openings are shown, more or less such openings may be used. The dotted lines in FIG. 4 denote where folding occurs during assembly of the base member. A plurality of tabs 80–86 are also shown, which are fastened adhesively or otherwise when forming the base member of the package. A centrally disposed cavity 48 is formed by removing that circular region of the cardboard prior to constructing the base member 12.

The base member is constructed by first folding the tab 80 and rectangular floor 14 along the dotted lines 87, 88, and then folding the front 20 and rear 22 ball holder panels along the dotted lines 89, 90 to form a tube having a generally rectangular cross section. The tab 80 is fastened to the inside of the rear ball holder panel 22. Next, the four tabs 81, 82, 83, 84 are folded ninety degrees along dotted lines 91, 92, 93, 94 in preparation for connection to the inner portion of the side panels 16 and 18. Next, the side panels 16, 18 are folded ninety degrees along dotted lines 95, 96, and tabs 85, 86 are folded ninety degrees along dotted lines 97, 98. The four tabs 81, 82, 83, 84 are attached to the inside portions of side panels 16, 18, and the tabs 85, 86 are attached to the inside portion of floor 14. When the base member 12 is fully assembled, the four openings 28, 30, 32, 34 are aligned with the holes 100, 101, 102, 103 on the floor 14, and are aligned with the holes 104, 105, 106, 107 on each of the tabs 85, 86. In a preferred embodiment, during final assembly of the package, a screw is inserted through holes 100, 101, 102, 103 of the base member for attachment to each of the columns.

When the base member of FIG. 4 is fully formed, the cavity 48 is ready to receive a portion of a ball as shown in FIGS. 2 and 3. The unitary base member 12 and another matching base member are formed in the same manner to form the upper and lower base members. Each base member contains spaced apart openings in the same positions for receiving columns, so that the columns will be aligned in the finished ball package.

Figure 5A:
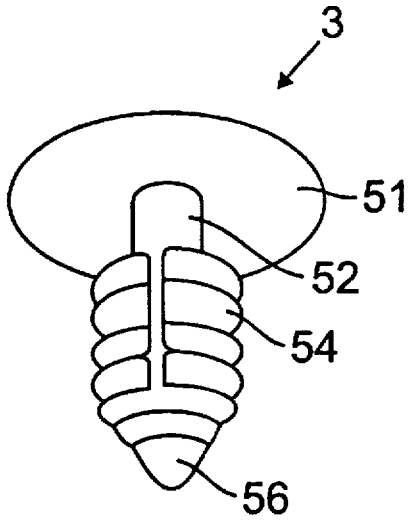
FIG. 5A illustrates an embodiment of a plastic screw.
Figure 5B:
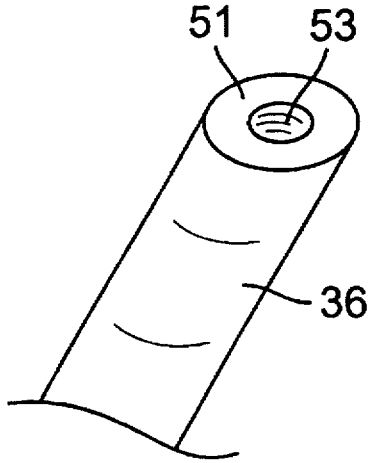
FIG. 5B is a cutaway perspective view of a column.

FIG. 5A is a perspective view of a plastic ridged fastener or screw 3 suitable for use in the construction of the ball package 1, and FIG. 5B is a cutaway perspective view of a column 36. Although preferably composed of plastic, the screw 3 may be made of metal, cardboard, wood, rubber or some other composite material.

Referring to FIG. 5A, the screw 3 has an oversized head portion 50 that may contain a slot for accepting a turning tool, a shaft 52, threads 54 and a conical tip 56. The oversized head portion 50 is preferably thin and flat so that when the package is formed, the head lies flat against the floor 14 or top portion 4, as shown in FIGS. 1–3. The diameter of the threads 54 are sized to fit through the holes 100, 101, 102, 103 in the floor 14 of FIG. 4, and through the holes 104, 105, 106, 107 in tabs 85, 86 for attachment to a column. In particular, FIG. 5B depicts the top portion of a column 36 having an end portion 51 with a threaded entryway 53. The conical tip 56 of the screw 3 fits into the threaded entryway 53, and the threads 54 are then engaged therein. Each end of each column in a preferred embodiment contains such threaded entryways, to allow easy attachment of the column to the top and bottom base members to form the ball package. Alternately, a ridged fastener could be used, which is pushed into the entryway of the columns under pressure and snaps in place.

In a preferred embodiment, the ball package is assembled by first connecting the columns 36, 38, 40, 42 to the bottom base member 12 by screws 3 (see FIG. 1). Next, a ball is placed on top of the bottom base member 12 and between the columns 36, 38, 40 and 42. Then the top base member 2 is placed on top of the ball and columns, and screws 3 are inserted through the top portion 4 to connect to each of the columns. Each of the columns 28, 30, 32 and 34 is inserted through the inner slots 28, 30, 33, 34 (shown in FIGS. 1 and 4) of the inner ball holder panels of the base members until they reach the top portion 4 and floor 14, then screws 3 are inserted through each of the screw holes in the top portion 4 and floor 14. The screws 3 are preferably hand tightened to ensure that the ball is firmly held between the columns and the top and bottom base members, but an automatic assembly machine may be used.

FIG. 6 is a front view of an alternate embodiment 60 of a ball package according to the invention. In this embodiment two balls 57, 59 are contained within the package 60. The top 61 and bottom 62 base members have front and rear ball holder panels designed to hold a plurality of balls, and are connected by columns 63, 64, 65, 66 which in conjunction with columns on the rear side of the package (not shown), combine to hold both of the balls snugly therein.

A ball package according to the invention is therefore a simple, attractive and functional container that effectively displays various types of sports balls of which a basketball is but one illustrative example. The invention could also be used with articles which are not likely to roll which can be supported between the base members and columns. Thus, it should be understood that the present invention includes not only those specific features disclosed herein but also all modifications and equivalents falling within the scope of the appended claims.

What is claimed is:

1. A package for a ball, comprising:

a bottom member having a substantially planar base surface, a front and rear panel, a left and right side panel, and a left and right side inner panel, wherein the front, rear, left inner and right inner panels form a centrally disposed cavity for receiving a bottom portion of a ball, and wherein the left and right inner panels contain a plurality of spaced apart openings;

a plurality of columnar members of a length substantially the same as a diameter of the ball, each having upper and lower ends, the lower ends of each columnar member being received in the openings of the left and right inner panels of the bottom member, and wherein the columnar members are attached to the bottom member; and a top member having a substantially planar base surface that is parallel to the base surface of the bottom member, a front and rear panel, a left and right side panel, and a left and right side inner panel, wherein the front, rear, left inner and right inner panels form a centrally disposed cavity for receiving the top portion of a ball, and wherein the left and right inner panels contain a plurality of spaced apart openings that match the spaced apart openings of the bottom member for receiving the upper ends of each columnar member for attachment thereto, wherein when the package is assembled a portion of the surface of the ball is accessible to a consumer.

2. The package of claim 1, further comprising:

a plurality of fasteners for securing the columnar members to the top and bottom members.

3. The package of claim 1, wherein the top and bottom members are formed from a unitary piece of material.

4. The package of claim 3, wherein the material is cardboard.

5. The package of claim 3, wherein the material is metal.

6. The package of claim 3, wherein the material is plastic.

7. The package of claim 3, wherein the material is a composite material.

8. The package of claim 1, wherein the top and bottom members are rectangular in shape.

9. A package for a plurality of balls, comprising:

a bottom member having a substantially planar base surface, a front and rear panel, a left and right side panel, and a left and right side inner panel, wherein the front, rear, left inner and right inner panels form a plurality of cavities for receiving the bottom portions of the balls, and wherein the left and right inner panels contain a plurality of spaced apart openings;

a plurality of columnar members of a length substantially the same as a diameter of the balls, each having upper and lower ends, the lower ends of each columnar member being received in the openings of the left and right inner panels of the bottom member, and wherein the columnar members are attached to the bottom member; and a top member having a substantially planar base surface that is parallel to the base surface of the bottom member, a front and rear panel, a left and right side panel, and a left and right side inner panel, wherein the front, rear, left inner and right inner panels form a plurality of cavities for receiving the top portion of the balls, and wherein the left and right inner panels contain a plurality of spaced apart openings that match the spaced apart openings of the bottom member for receiving the upper ends of each columnar member for attachment thereto, wherein when the package is assembled a portion of the surface of the balls is accessible to a consumer.

10. The package of claim 9, further comprising:

a plurality of fasteners for securing the columnar members to the top and bottom members.

11. The package of claim 1, wherein the top and bottom members are formed from a unitary piece of material.

12. The package of claim 3, wherein the material is cardboard.

13. The package of claim 3, wherein the material is metal.

14. The package of claim 3, wherein the material is plastic.

15. The package of claim 3, wherein the material is a composite material.

16. The package of claim 9, wherein the top and bottom members are rectangular.

* * * * *